US007564423B2

(12) United States Patent
Ke et al.

(10) Patent No.: US 7,564,423 B2
(45) Date of Patent: Jul. 21, 2009

(54) PRINTED DIPOLE ANTENNA

(75) Inventors: Yun-Long Ke, Tu-Cheng (TW); Wen-Fong Su, Tu-Cheng (TW); Yao-Shien Huang, Tu-Cheng (TW); Chen-Ta Hung, Tu-Cheng (TW); Shih-Tung Chang, Tu-Cheng (TW); Chin-Pao Kuo, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 215 days.

(21) Appl. No.: 11/446,692

(22) Filed: Jun. 5, 2006

(65) Prior Publication Data

US 2006/0273977 A1 Dec. 7, 2006

(30) Foreign Application Priority Data

Jun. 3, 2005 (TW) ..... 94209329 U

(51) Int. Cl.
*H01Q 1/38* (2006.01)
*H01Q 9/28* (2006.01)

(52) U.S. Cl. ..... 343/795; 343/829

(58) Field of Classification Search ..... 343/795, 343/829

See application file for complete search history.

(56) References Cited

U.S. PATENT DOCUMENTS 4,860,019 A * 8/1989 Jiang et al. ..... 343/795

FOREIGN PATENT DOCUMENTS

TW 253069 12/2004

* cited by examiner

*Primary Examiner*—Michael C Wimer
(74) *Attorney, Agent, or Firm*—Wei Te Chung

(57) ABSTRACT

A printed dipole antenna used in an electronic device comprising a PCB comprising some through holes; a grounding element locating on one side of the PCB; a radiating element locating on common side of the PCB with the grounding element; a coaxial cable comprising a inner conductor connecting to the radiating element and a braiding layer connecting to the grounding element; and a short circuit element locating on another side of the PCB electrically connecting the radiating element and the grounding element by said through holes. When the printed dipole antenna encounter an intense electromagnetic field, the interferential signal transmitting from the intense electromagnetic field would arrive to the grounding element through the radiating element. The interferential signal cannot arrive to the system and is unable disturb the working of the printed dipole antenna.

13 Claims, 6 Drawing Sheets

PRINTED DIPOLE ANTENNA

BACKGROUND OF THE INVENTION

1. Field of the Invention

The present invention relates to an antenna, and in particular of to the dipole antenna employed in a laptop computer, a portable electrical device or other electrical devices.

2. Description of the Prior Art or Related Art

With the development of wireless communication, transmitting and receiving information without infection by the environment is very preferable to user. However, the quality of the wireless communication largely depend on the performance and pattern of the antenna in which the signal is transmitted. So, the quality performance of the antenna is very important to the wireless communication between electronic devices, such as Notebook computer and wireless router.

The conventional dipole antenna or helix antenna usually needs a great deal of inner space of electrical device so as to be properly installed therein. It becomes an obstacle of the trend of miniaturization development of the wireless communication device. As a result, an antenna printed on a substrate, such as PCB, which needs less and relatively small space is used in portable electrical device.

The PCB antenna concentrates wireless transport components on one PCB. So, the PCB antenna not only occupies small space but also can make cost down of the manufacture.

For example, TW Patent No. 253069 discloses a printed dipole antenna. Referring to FIG. 1, the printed dipole antenna comprises a radiating element 16, a grounding element 18, an insulative patch 10 and a conductor line (not show). The radiating element 16 is located on the left side of the insulative patch and the grounding element 18 is located on the right side of the insulative patch. The radiating element 16 has a first feeding point 5, while the grounding element 18 has a second feeding point 7. The inner conductor of the conductor line is soldered to the first feeding point 5 and the braiding layer of the conductor line is soldered to the second feeding point 7.

Though the dipole antenna disclosed in TW 253069 occupies small space, the radiating element 16 and the grounding element 18 are separated from each other, when the dipole antenna encounters or operated under an intense electromagnetic field, the background noises transmitted from the intense electromagnetic field would arrive at system through the radiating element 16. As a result, the antenna system will fail to distinguish which is working signal and which is from the background noises and cause the system fail to work functionally.

Hence, in this art, a printed antenna to overcome the above-mentioned disadvantages of the prior art will be described in detail in the following embodiment.

BRIEF SUMMARY OF THE INVENTION

A primary object, therefore, of the present invention is to provide a printed dipole antenna with a function of filtrating background noises and decreased lengths of the radiating trace and the grounding trace of the printed dipole antenna.

It is a object of the present invention to provide a printed dipole antenna having "a short circuit element" so as to filter background noises.

In order to achieve the above mentioned object and overcomes the above-identified deficiencies in the prior art, the printed dipole antenna accordance with the present invention comprises a grounding element; a radiating element comprising a first radiating section operating at 900 MHz frequency band and a second radiating section operating at 1800 MHz frequency band; and a connecting element connecting the radiating section and the grounding section. The grounding element, the radiating element, and the connecting element locate respectively in the different plane.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
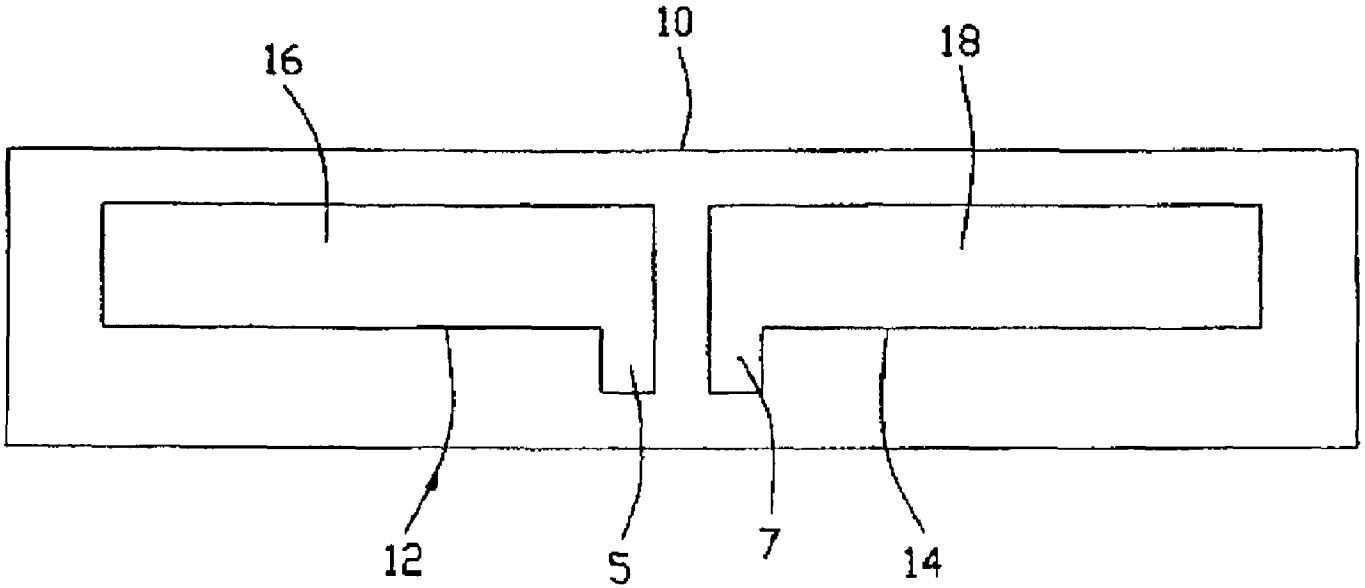
FIG. 1 (PRIOR ART)
FIG. 1 is a perspective view of a conventional printed dipole antenna.
Figure 2:
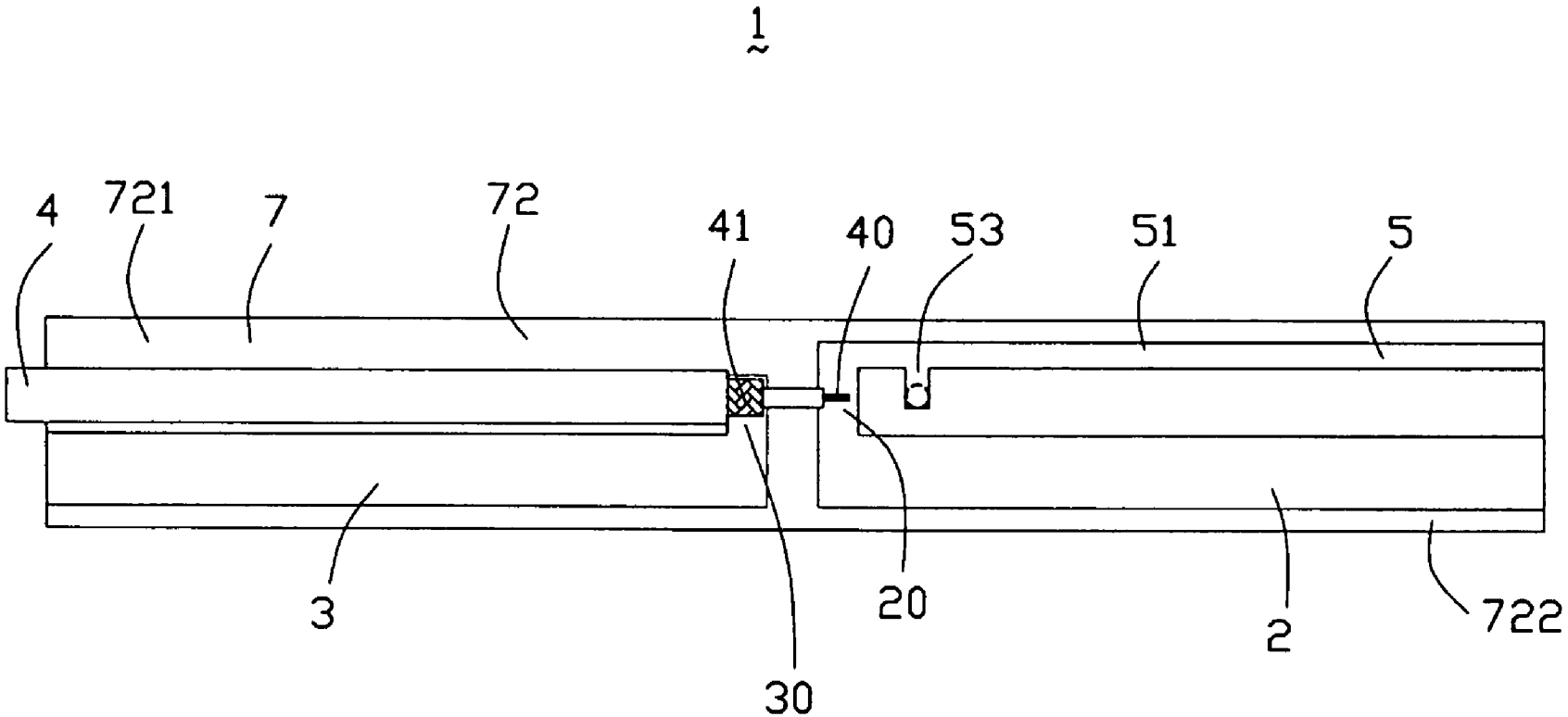
FIG. 2 is a top plan view of a printed dipole antenna in accordance with primary embodiment of the present invention.

Referring to FIG. 2, the printed dipole antenna 1 of the present invention is formed on an insulative patch 7. The printed dipole antenna 1 comprises a radiating element 2, a grounding element 3, a coaxial cable 4, and a short circuit element 5.

Figure 3:
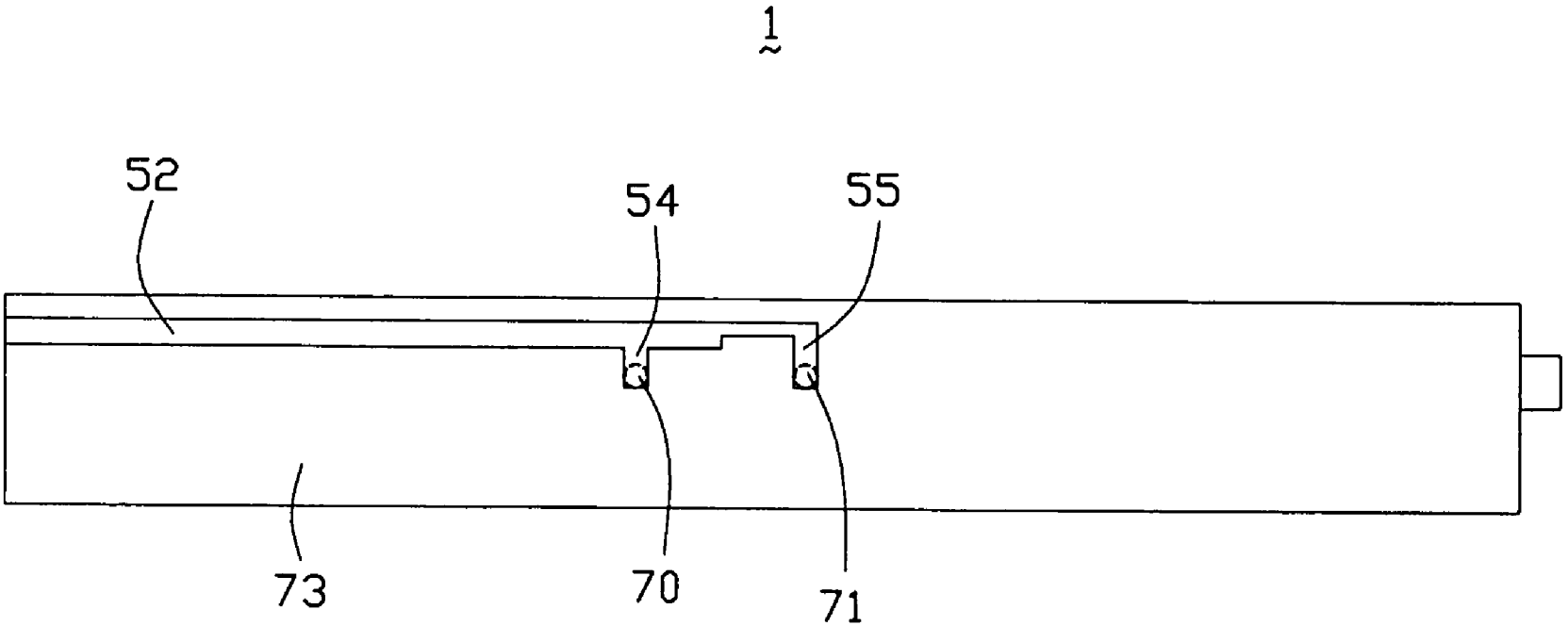
FIG. 3 is a bottom plan view of a printed dipole antenna in accordance with primary and second embodiments of the present invention.

Referring to FIGS. 2 and 3, it shows the primary embodiment of the printed dipole antenna 1 of the present invention. The radiating element 2 and the grounding element 3 are set symmetrically on opposite sides 721, 722 of a first surface 72 of the insulative patch 7. The radiating element 2 and the grounding element 3 are approximately formed as rectangle. A first soldering section 20 extends from one end of the radiating element 2 perpendicularly to the radiating element 2. A second soldering section 30 extends from one end of the grounding element 3 perpendicularly to the grounding element 3.

The coaxial cable 4 comprises an inner conductor 40 soldered to the first soldering section 20 and a braiding layer 41 soldered to the second soldering section 30.

The short circuit element 5 comprises a first short circuit branch 51 and a second short circuit branch 52. The length of the first short circuit branch 51 and the second short circuit 52 is ¼ wavelength of the printed dipole antenna 1. The first short circuit 51 extends from the first soldering section 20 along a longitudinal direction and parallel to the radiating element 2. The second short circuit branch 52 is formed on a second surface 73 of the insulative patch 7 and in mirror with the first short circuit branch 51. A first tab 53 extends perpendicularly from a side of the first short circuit branch 51 and adjacent to the first soldering section 20. A second tab 54 and a third tab 55 extend perpendicularly from the second short circuit branch 52 respectively corresponding to the first tab 53 and located at a distal end of the second short circuit branch 52. The first tab 53 is in mirror with the second tab 54 forming on the second surface 73 of the insulative patch 7. The third tab 55 is partially coincides with the second soldering section 30 forming on the first surface 72 of the insulative patch 7. The insulative patch 7 has first and second through holes 70, 71. The first through hole 70 electrically connects the first tab 53 and the second tab 54. the second through hole 71 electrically connects the third tab 55 and the second soldering section 30. So, the first short circuit branch 51, the second short circuit branch 52, the radiating element 2 and the grounding element 3 together form a short loop circuit. When the printed dipole antenna 1 encounters an intense electromagnetic field, the background noises transmitting from the intense electromagnetic field arrives at the grounding element 3 through the radiating element 2. However, the background noises cannot arrive to the system and is unable to disturb the operating of the printed dipole antenna 1. The length of the first short circuit branch 51 and the second short circuit branch 52 is ¼ wavelength of the printed dipole antenna 1, as know, when the length of a element of a antenna is ¼ operating wavelength of the antenna, the element can transmit and receive the operating frequency of the antenna, so the signal of the working frequency band of the printed dipole antenna 1 can be transmitted and received by the short circuit element 5, while the interferential signal of other frequency bands cannot be transmitted and received and arrive to the grounding element 3 because there frequency is different with the printed dipole antenna 1.

Figure 4:
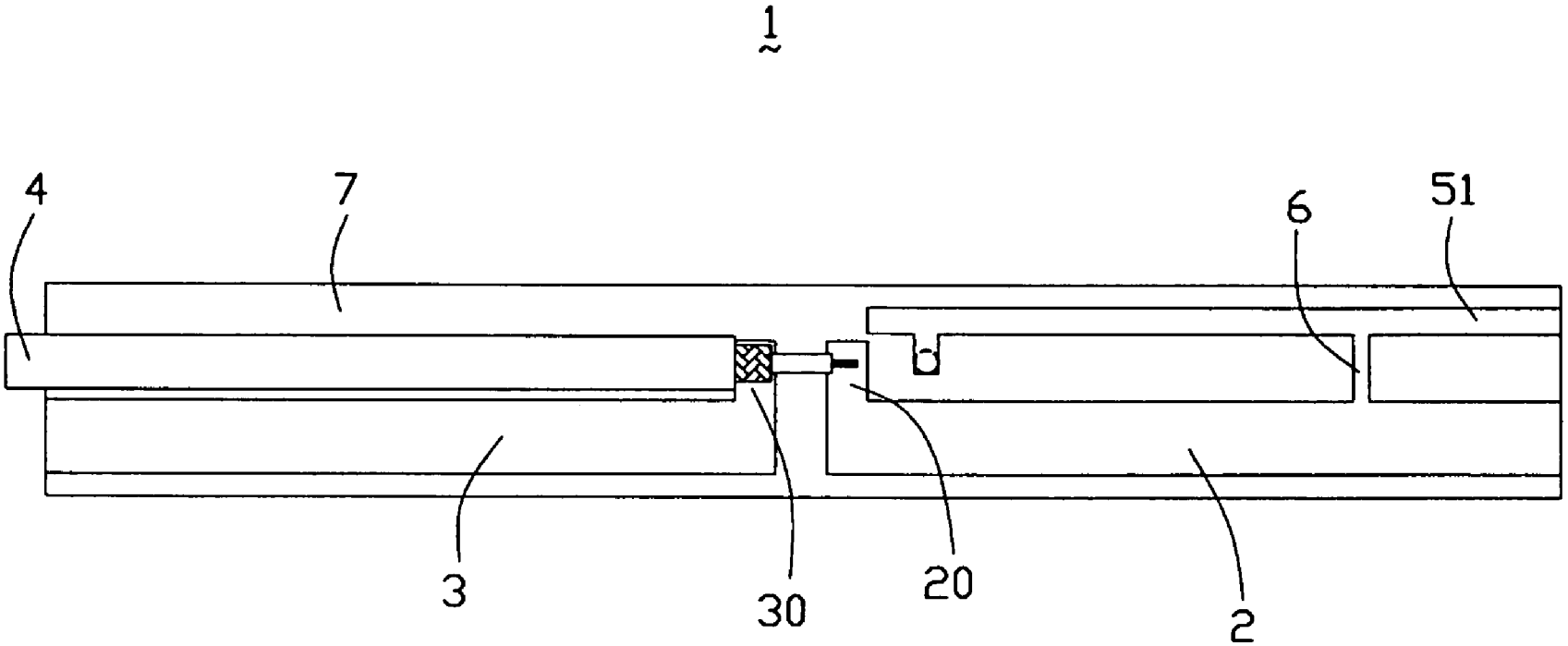
FIG. 4 is a top plan view of a printed dipole antenna in accordance with the second embodiment of the present invention.

Referring to FIGS. 3 and 4, it shows the second embodiment of the printed dipole antenna 1 of the present invention. In the second embodiment, a different compare with the primary embodiment is the first short circuit branch 51 is connected to the radiating element 2 by a vertical narrow connecting portion 6 at middle part of the radiating element. The first short circuit branch 51, the second circuit branch 52, the connecting portion 6, the radiating element 2 and the grounding element 3 together form a short loop circuit.

Figure 5:
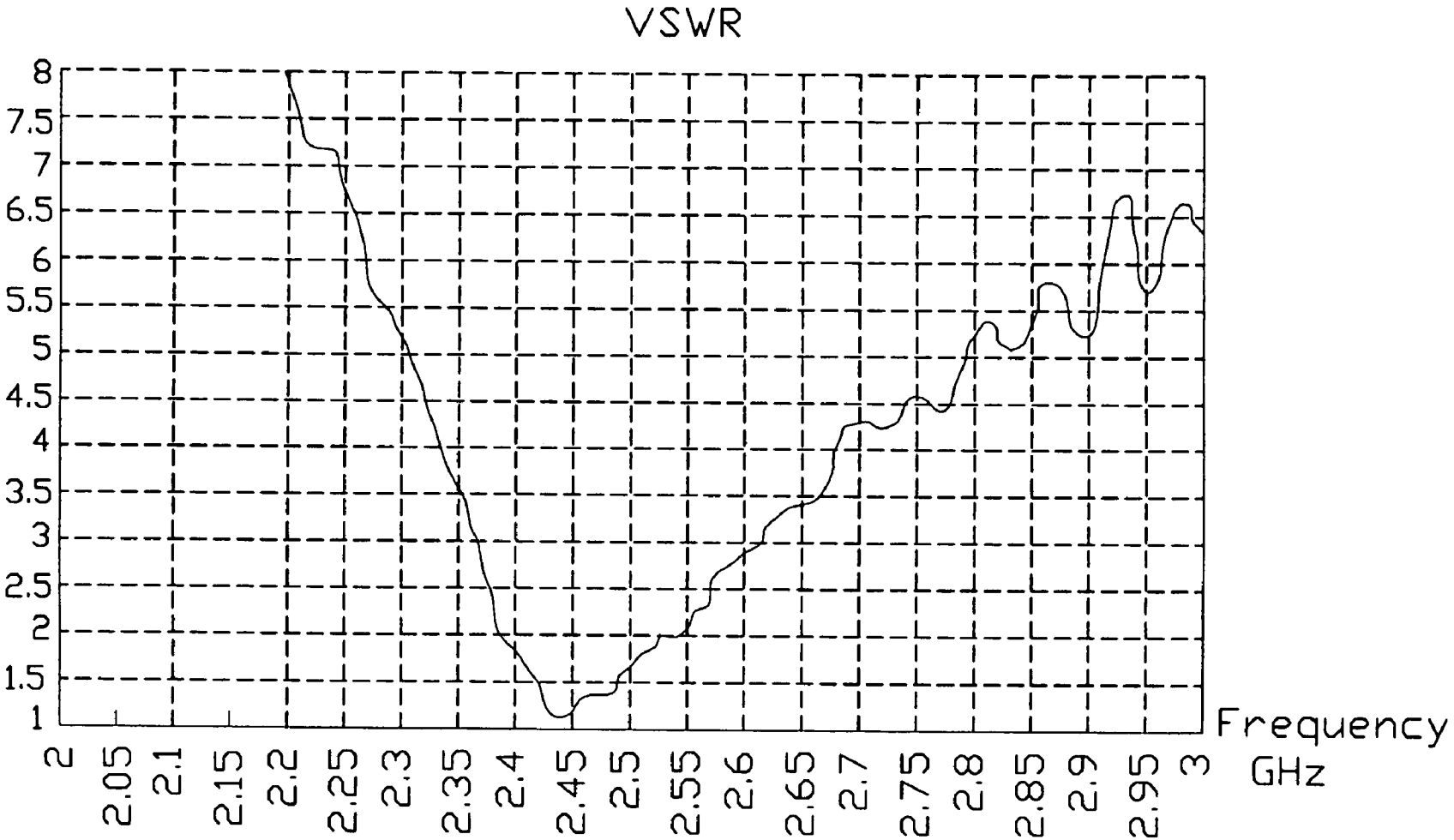
FIG. 5 is a test chart recording of Voltage Standing Wave Ratio (VSWR) of primary embodiment of the printed dipole antenna as a function of frequency.
Figure 6:
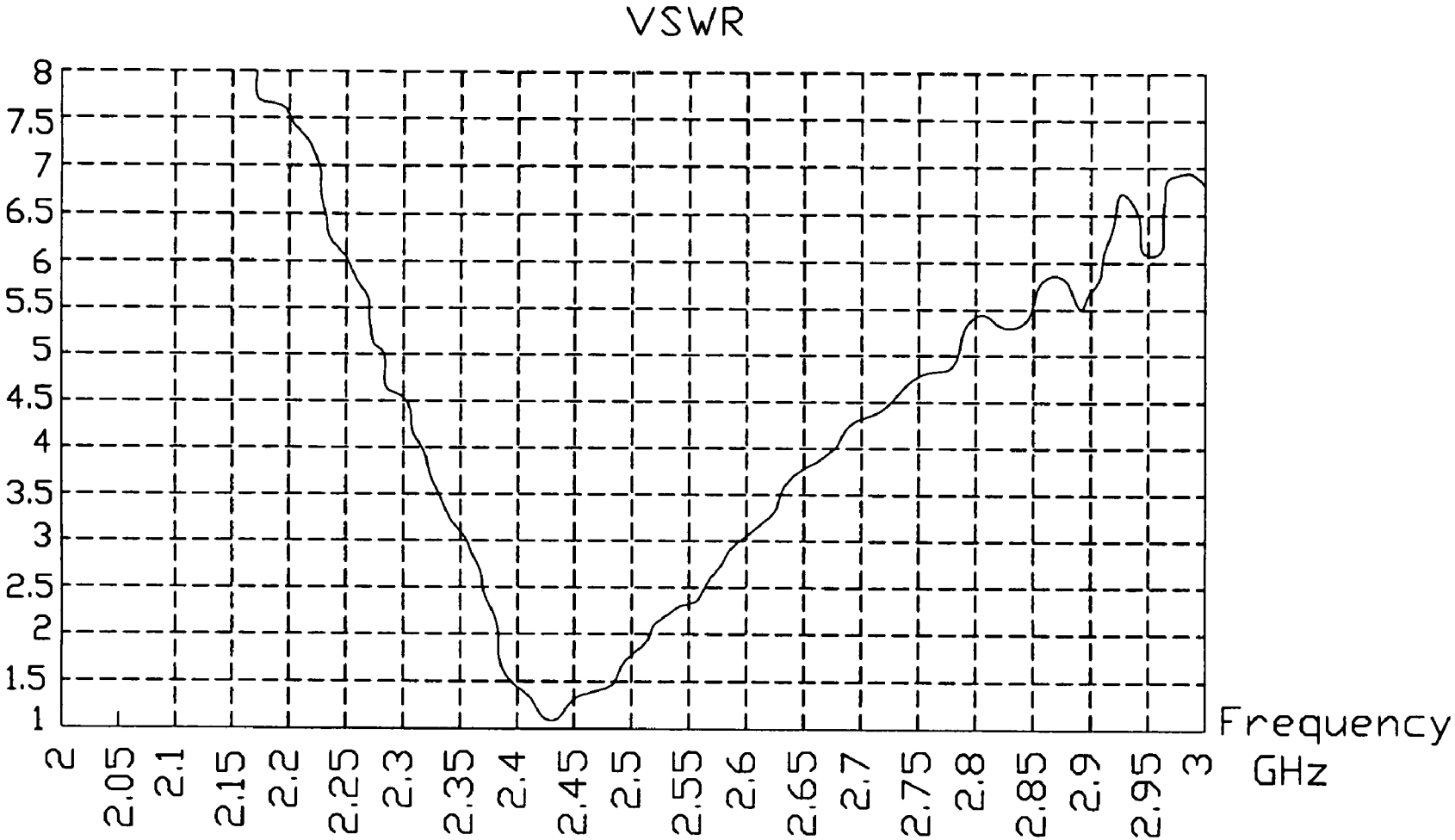
FIG. 6 is a test chart recording of Voltage Standing Wave Ratio (VSWR) of second embodiment of the printed dipole antenna as a function of frequency.

Referring to FIGS. 5 and 6, sets forth a test chart recording of Voltage Standing Wave Radio (VSWR) of the primary embodiment and the second embodiment of the printed dipole antenna 1 as a function of frequency. Note that VSWR drops below the desirable maximum value "2" in the 2.4-2.5 MHz frequency band, indicating acceptable efficient operation in this frequency band.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A printed dipole antenna used in an electronic device, comprising:

an insulative patch comprising at least one hole;

a grounding element located on one side of a first surface of the insulative patch;

a radiating element is coplanar with the grounding element and formed on another side of the first surface of the insulative patch;

a coaxial cable comprising an inner conductor connecting to the radiating element and a braiding layer connecting to the grounding element; and a short circuit element located on a second surface of the insulative patch extending through said hole so as to electrically connect the radiating element and the grounding element; wherein the short circuit element comprises a first short circuit branch and a second short circuit branch, the first short circuit branch and the radiating element located on the common first surface of the insulative patch, the second circuit branch located on the second surface of the insulative patch.

2. The printed dipole antenna as claimed in claim 1, wherein the length of each the first and second short circuit branches is ¼ operating wavelength.

3. The printed dipole antenna as claimed in claim 2, wherein the first short circuit branch electrically connects to the radiating element in means of a first soldering section.

4. The printed dipole antenna as claimed in claim 3, wherein the second short circuit branch electrically connects to the grounding element.

5. The printed dipole antenna as claimed in claim 4, wherein the insulative patch comprises a first through hole electrically connecting the second short circuit branch and the radiating element.

6. The printed dipole antenna as claimed in claim 5, wherein the insulative patch comprises a second through hole electrically connecting the second short circuit branch and the grounding element.

7. The printed dipole antenna as claimed in claim 1, wherein the radiating element is in mirror to the grounding element on the first surface of the insulative patch.

8. The printed dipole antenna as claimed in claim 6, wherein the first short circuit branch comprises a first tab extending perpendicularly from a side of the first short circuit branch.

9. The printed dipole antenna as claimed in claim 8, wherein the second short circuit branch comprises a second tab extending perpendicularly from a side of the second short circuit branch.

10. The printed dipole antenna as claimed in claim 9, wherein the first tab is in mirror with the second tab, the first and second tab electrically connected by means of said first through hole.

11. The printed dipole antenna as claimed in claim 9, wherein the second short circuit branch comprises a third tab extending perpendicularly from a side of the second short circuit branch, the grounding element comprises a second soldering section extending perpendicularly from a side of the grounding element the third tab is mirror with the second soldering section.

12. The printed dipole antenna as claimed in claim 11, wherein the third tab and the second soldering section are electrically connected by means of the second through hole.

13. The printed dipole antenna as claimed in claim 2, wherein the first short circuit branch electrically connects to the radiating element in means of a vertical connecting portion at middle part of the radiating element.

* * * * *